US007779648B2

(12) United States Patent
Manole et al.

(10) Patent No.: US 7,779,648 B2
(45) Date of Patent: Aug. 24, 2010

(54) HEAT EXCHANGER WITH ENHANCED AIR DISTRIBUTION

(75) Inventors: Dan M. Manole, Tecumseh, MI (US); Donald L. Coffey, Ann Arbor, MI (US)

(73) Assignee: Tecumseh Products Company, Tecumseh, MI (US)

( * ) Notice: Subject to any disclaimer, the term of this patent is extended or adjusted under 35 U.S.C. 154(b) by 533 days.

(21) Appl. No.: 11/262,187

(22) Filed: Oct. 28, 2005

(65) Prior Publication Data

US 2006/0090493 A1 May 4, 2006

Related U.S. Application Data

(60) Provisional application No. 60/623,953, filed on Nov. 1, 2004.

(51) Int. Cl.
*F25B 39/02* (2006.01)

(52) U.S. Cl. ..... 62/515; 62/903; 165/127; 165/164

(58) Field of Classification Search ..... 62/259.2, 62/262, 515, 524, 314, 414, 419, 903; 165/164, 165/165, 172, 178, 122, 124, 126, 127, 144, 165/157; 454/196, 197, 226, 227, 237, 253
See application file for complete search history.

(56) References Cited

U.S. PATENT DOCUMENTS

| | | | | |
|---|---|---|---|---|
| 1,149,065 A | | 8/1915 | Bain et al. | |
| 2,148,413 A | * | 2/1939 | Labberton et al. | 62/117 |
| 2,279,804 A | | 4/1942 | Walz | 62/104 |
| 2,546,417 A | | 3/1951 | Angling | 62/141 |
| 2,591,178 A | | 4/1952 | McAdam | 62/4 |
| 2,676,667 A | | 4/1954 | Dodge | 183/2 |
| 3,289,757 A | * | 12/1966 | Rutledge | 165/166 |
| 3,766,750 A | | 10/1973 | Aoh et al. | 62/259 |

(Continued)

FOREIGN PATENT DOCUMENTS

JP 2002-179602 A * 6/2002

OTHER PUBLICATIONS

Shannon, Mark A., et al., "Non-metallic, Flexible, Thin, Multichannel Heat Exchangers for Refrigeration and Air-Conditioning Applications", ACRC Project #144.

(Continued)

*Primary Examiner*—Mohammad M Ali
(74) *Attorney, Agent, or Firm*—Baker & Daniels LLP

(57) ABSTRACT

A complete refrigeration system (CRS) including at least one heat exchanger which is designed to occupy an irregular volume to reduce the overall profile of the CRS. The heat exchanger may be a condenser or an evaporator, and includes a substantially solid body made of a thermally conductive metal, plastic, or other material. A plurality of fluid and refrigerant passageways are defined substantially within the solid body for conducing fluid and refrigerant, respectively, through the solid body and facilitating the transfer of heat between the fluid and refrigerant. Also disclosed is a method wherein the spatial orientation of each passageway is optimized with respect to all of the other passageways and the walls of the solid body by determining the relative distance of each passageway from all of the other passageways and the walls of the solid body at a plurality of points along each passageway, followed by adjusting the spatial orientation of the passageway accordingly.

10 Claims, 12 Drawing Sheets

U.S. PATENT DOCUMENTS

| | | | | |
|---|---|---|---|---|
| 4,081,025 | A * | 3/1978 | Donaldson | 165/140 |
| 4,285,204 | A | 8/1981 | Vana | 62/81 |
| 5,031,693 | A * | 7/1991 | VanDyke | 165/166 |
| 5,582,240 | A * | 12/1996 | Widmayer | 165/80.3 |
| 6,023,940 | A * | 2/2000 | Abbott et al. | 62/504 |
| 6,092,377 | A * | 7/2000 | Tso | 62/173 |
| 6,155,065 | A * | 12/2000 | da Silva | 62/262 |
| 6,301,914 | B1 * | 10/2001 | Oliva et al. | 62/262 |
| 6,381,974 | B1 * | 5/2002 | Hwang et al. | 62/199 |
| 6,519,500 | B1 | 2/2003 | White | 700/119 |
| 6,658,882 | B2 * | 12/2003 | Ohama et al. | 62/262 |
| 6,698,228 | B2 * | 3/2004 | Kateman et al. | 62/346 |
| 6,751,973 | B2 * | 6/2004 | Erisgen | 62/246 |
| 6,804,975 | B2 * | 10/2004 | Park | 62/324.1 |
| 6,948,324 | B2 | 9/2005 | Jin | 62/77 |
| 2004/0101421 | A1 * | 5/2004 | Kenny et al. | 417/313 |

OTHER PUBLICATIONS

Thonon, B, et al., "Compact Heat Exchangers Technologies for the HTRs Recuperator Application", Grenoble, France, date unknown.

Bejan, Adrian; "From Heat Transfer Principles to Shape and Structure in Nature: Cosntructal Theory", 1999 Max Jakob Memorial Award Lecture, copyright 2000.

eProduct #47 at achrnews.com; "'Cube' Gives Refrigeration a Modular Look", Aug. 4, 2003.

Chiu, Daniel T. et al.; "Using Three-dimensional Microfluidic Networks for Solving Computationally Hard Problems", PNAS, Mar. 13, 2001.

Martin, Peter M. et al.; "Laminated Ceramic Microfluidic Components for Microreactor Applications", Pacific Northwest National Laboratory, dated unknown.

Bejan, Adrian; "Shape and Structure, from Engineering to Nature", Cambridge University Press, date unknown.

Canadian Office Action dated Oct. 9, 2009 in corresponding Canadian Application No. 2,524,820.

* cited by examiner

HEAT EXCHANGER WITH ENHANCED AIR DISTRIBUTION

CROSS-REFERENCE TO RELATED APPLICATION

This application is related to and claims the benefit under 35 U.S.C. §119(e) of U.S. Provisional Patent Application Ser. No. 60/623,953, filed Nov. 1, 2004.

BACKGROUND OF THE INVENTION

1. Field of the Invention

The present invention relates to complete refrigeration systems and, in particular, to the construction and arrangement of heat exchangers used in complete refrigeration systems.

2. Description of the Related Art

Complete refrigeration systems (CRS) are typically manufactured as self-contained modules or units which contain all the necessary components to provide refrigeration for a given application, such as a refrigerator, a vending machine, an electronics component, or other applications. A CRS is typically manufactured and packaged as a modular unit including a compressor, a condenser, an expansion device, and an evaporator, with the foregoing components mounted to a base plate and fluidly connected to one another by suitable refrigerant conduits. The CRS unit may then be shipped from the CRS manufacturer to an original equipment manufacturer (OEM) who installs the CRS within the enclosure of an appliance, such as a refrigerator, vending machine, or electronics component, for example.

A typical CRS configuration is shown in FIG. 1. The CRS includes compressor 20, condenser 22, expansion device 24, shown as a capillary tube, and evaporator 26 connected in serial order by refrigerant conduits. Compressor 20 may be a scroll compressor, a reciprocating piston compressor, a rotary compressor, or any other type of compressor known in the art. Evaporator 26 and condenser 22 are constructed as box-shaped components having large surface areas, including fins 27, to facilitating the transfer of thermal energy. Fans 28*a* and 28*b* may be positioned to move air over evaporator 26 and condenser 22. Fan 28*a* at condenser 22 moves air over condenser 22 and discharges the heated air from a space to be cooled in the application (not shown) to the ambient environment 30, and fan 28*b* at evaporator 26 moves air from within the space to be cooled over evaporator 26 to cool the air, followed by discharging the cooled air back into the space to be cooled. The entire CRS is mounted on base plate 29 for easy shipping and installation into an appliance or other refrigeration application. Base plate 29 typically has a rectangular shape, and a framework 31 may be connected to base plate 29, the framework 31 optionally including sides and a top (not shown).

A potential disadvantage of these types of CRS units in certain applications is that the geometry of the evaporator and the condenser requires that the CRS unit itself occupy a rather large, substantially rectangular (cuboidal) volume or profile. Additionally, as may be seen in FIG. 1, the use of conventionally-shaped, box-type condensers and evaporators may result in a relatively large amount of unused space within the overall rectangular volume or profile of the CRS unit, such as the space around the compressor. Further, when a CRS unit is used in an electronics application, such as in a computer, a server, or other electronic equipment, the overall space occupied by the CRS within the electronic component must be minimized.

It is desirable to have a CRS for use in refrigeration applications which is an improvement over the foregoing.

SUMMARY OF THE INVENTION

The present invention provides a complete refrigeration system (CRS) including at least one heat exchanger which is designed to occupy an irregular, non-cuboidal volume to reduce the overall profile of the CRS. The heat exchanger may be a condenser or an evaporator, and includes a substantially solid body made of a thermally conductive metal, plastic, or other material. A plurality of fluid and refrigerant passageways are defined substantially within the solid body for conducing fluid and refrigerant, respectively, through the solid body and facilitating the transfer of heat between the fluid and refrigerant. Also disclosed is a method wherein the spatial orientation of each passageway is optimized with respect to all of the other passageways and the walls of the solid body by determining the relative distance of each passageway from all of the other passageways and the walls of the solid body at a plurality of points along each passageway, followed by adjusting the spatial orientation of the passageway accordingly.

In one exemplary embodiment, the solid body of the heat exchanger has an irregular, non-cuboidal exterior shape that extends at least partially around the compressor to more effectively utilize the interior volume of the CRS. The heat exchanger, in one form, is an evaporator having fluid inlets and fluid outlets in fluid communication with an enclosed space to be cooled. The fluid inlets and fluid outlets are connected by fluid passageways extending through the evaporator which are substantially disposed within the solid body of the evaporator. The evaporator also includes a refrigerant inlet and a refrigerant outlet connected by refrigerant passageways which are also substantially disposed within the solid body of the evaporator. The fluid passageways and the refrigerant passageways are optimally positioned with respect to one another for efficient thermal transfer between the fluid and the refrigerant.

In one exemplary embodiment, each fluid passageway is divided at a fluid moving device, such as a fan disposed within the heat exchanger, into two corresponding sections. Each first section of each fluid passageway is in fluid communication with its corresponding second section. In another exemplary embodiment, refrigerant enters the refrigerant inlet of the heat exchanger and flows through a first plurality of refrigerant passageways. The first plurality of refrigerant passageways then merge into a single passageway to bypass the fluid moving device, after which the single passageway diverges into a second plurality of refrigerant passageways which merge at the refrigerant outlet to allow the refrigerant to exit the heat exchanger.

Heat exchangers in accordance with the present invention may be manufactured using a variety of methods. In one exemplary method, the solid body is divided into a number of segments or slices, and each slice is manufactured individually and then attached to a corresponding slice or slices. Each slice, or the entire heat exchanger itself, may be manufactured by any of a number of methods including, stamping, solidification transformation, or layer addition, for example.

One exemplary method for determining the optimal spatial orientation of the fluid and refrigerant passageways for effective thermal transfer within the heat exchanger involves drawing a straight line from each fluid or refrigerant inlet to its corresponding outlet. An equal number of nodes are then spaced equidistant from one another on each passageway. Using a plane intersecting a first passageway at a node, a calculation of the relative location of the node with respect to all other passageways and to the outer surfaces of the heat exchanger is performed. The most effective placement of the node of the first passageway is then determined. Then, a new plane is positioned on the next node of the first passageway and the calculation repeated. This process is performed for each node of the first passageway. Once the position of all the nodes on a passageway have been calculated, a new passageway is selected and the process is repeated. This process continues through numerous iterations until the desired spatial efficiency is obtained.

In one form thereof, the present invention provides a heat exchanger including a substantially solid body having a volume; a plurality of first, fluid-conducting passageways within the body extending between at least one fluid inlet and at least one fluid outlet, at least two of the first passageways having different relative extents of travel between the at least one inlet and at least one outlet.

In another form thereof, the present invention provides a complete refrigeration system including a refrigerant circuit including, in serial order, a compressor, a first heat exchanger, an expansion device, and a second heat exchanger, one of the first and second heat exchangers including a substantially solid body having a volume; a plurality of first, fluid-conducting passageways within the body and extending between at least one fluid inlet and at least one fluid outlet, at least two of the first passageways defining different relative lengths between the at least one inlet and at least one outlet; and a plurality of second, refrigerant-conducting passageways within the body and extending between at least one refrigerant inlet and at least one refrigerant outlet.

In a further form thereof, the present invention provides a method for determining an efficient spatial orientation for a plurality of passageways within a heat exchanger having a solid body, at least one inlet, and at least one outlet, including the steps of determining the geometry of outer surfaces of the heat exchanger; determining locations for at least one inlet and at least one outlet with respect to the outer surfaces; calculating, for at least one passageway extending between a respective inlet and outlet, at least one of a distance between the passageway and another passageway and a distance between the passageway and one of the outer surfaces; and adjusting the orientation of the at least one passageway based on the at least one calculated distance.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION

Figure 2:
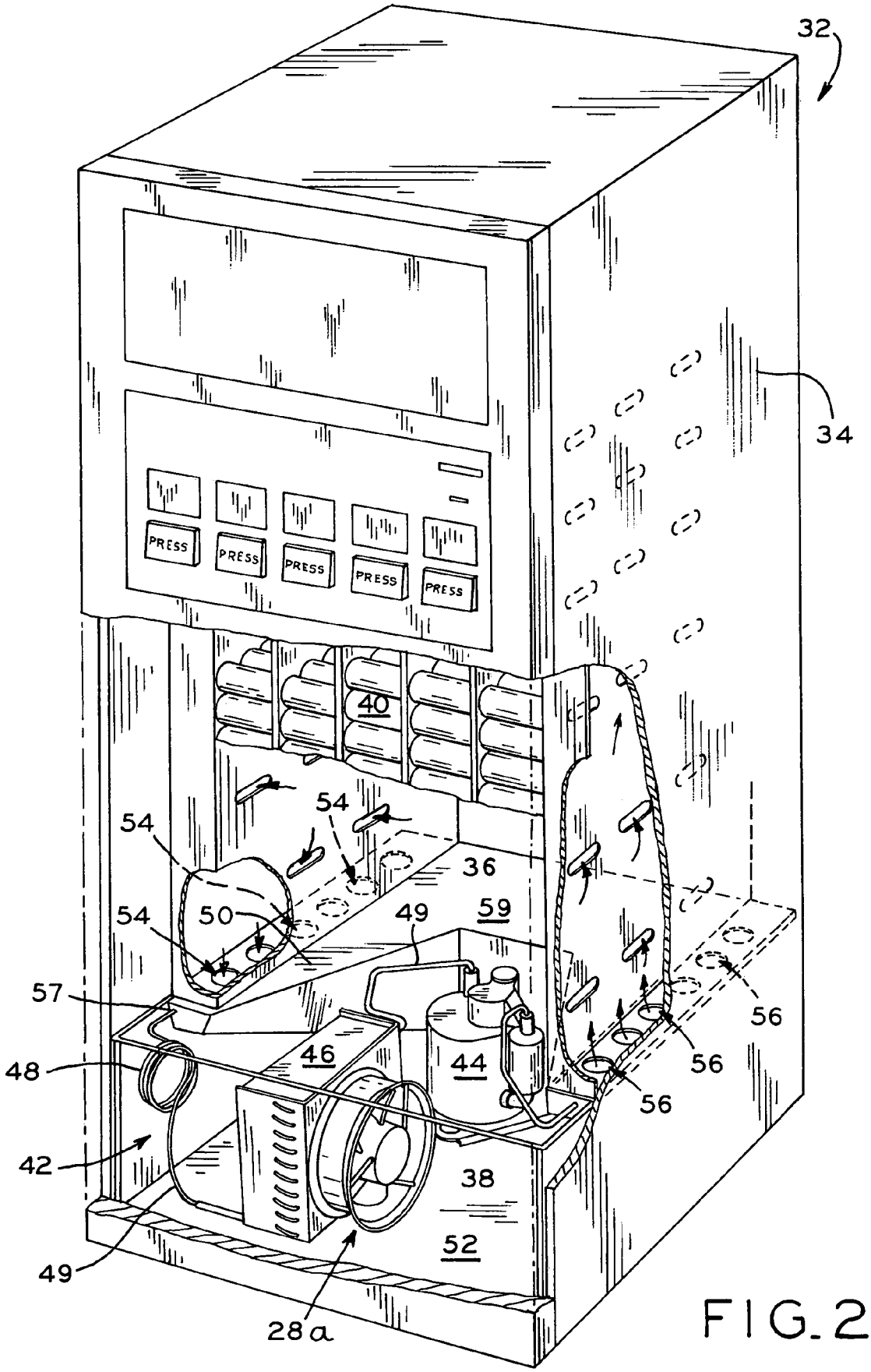
FIG. 2 is a perspective cut-away view of a vending machine, which is shown as an exemplary application including a CRS in accordance with the present invention.

FIG. 2 shows an exemplary refrigeration device, depicted herein as vending machine 32. Vending machine 32 includes housing 34 defining upper interior volume 36 and lower interior volume 38. Upper interior volume 36 is a substantially enclosed, refrigerated space, containing a plurality of articles to be refrigerated, shown herein as a plurality of beverage cans 40. Lower interior volume 38 contains complete refrigeration system (CRS) 42 of the present invention. CRS 42 includes compressor 44, first heat exchanger or condenser 46, expansion device 48, and second heat exchanger or evaporator 50, the foregoing connected in serial order by refrigerant conduits 49. CRS 42 is mounted on base plate 52 allowing CRS to be assembled as a modular unit which is mounted within lower interior volume 38 of vending machine 32.

Evaporator 50 includes a plurality of fluid inlets 54 and fluid outlets 56 both in fluid communication with upper interior volume 36 through suitable ductwork. In operation, fluid inlets 54 of evaporator 50 accept air from upper interior volume 36 and, as described below, the air is moved through a plurality of passageways within the solid body of evaporator 50 by an air moving device, wherein the air is cooled by extracting heat therefrom before being discharged through fluid outlets 56. In this manner, circulation and extraction of heat from the air within upper interior volume 36 keeps same at a temperature lower than that of the ambient environment, cooling upper interior volume 36 and beverage cans 40. Although CRS of the present invention has been described in connection with an exemplary application, shown herein as vending machine 32, it should be understood that CRS may also be used in other similar applications, such as refrigerators, freezers, etc. Further, CRS may also be scaled and configured for use in other applications, such as in computers, servers, and other electronic equipment.

Figure 1:
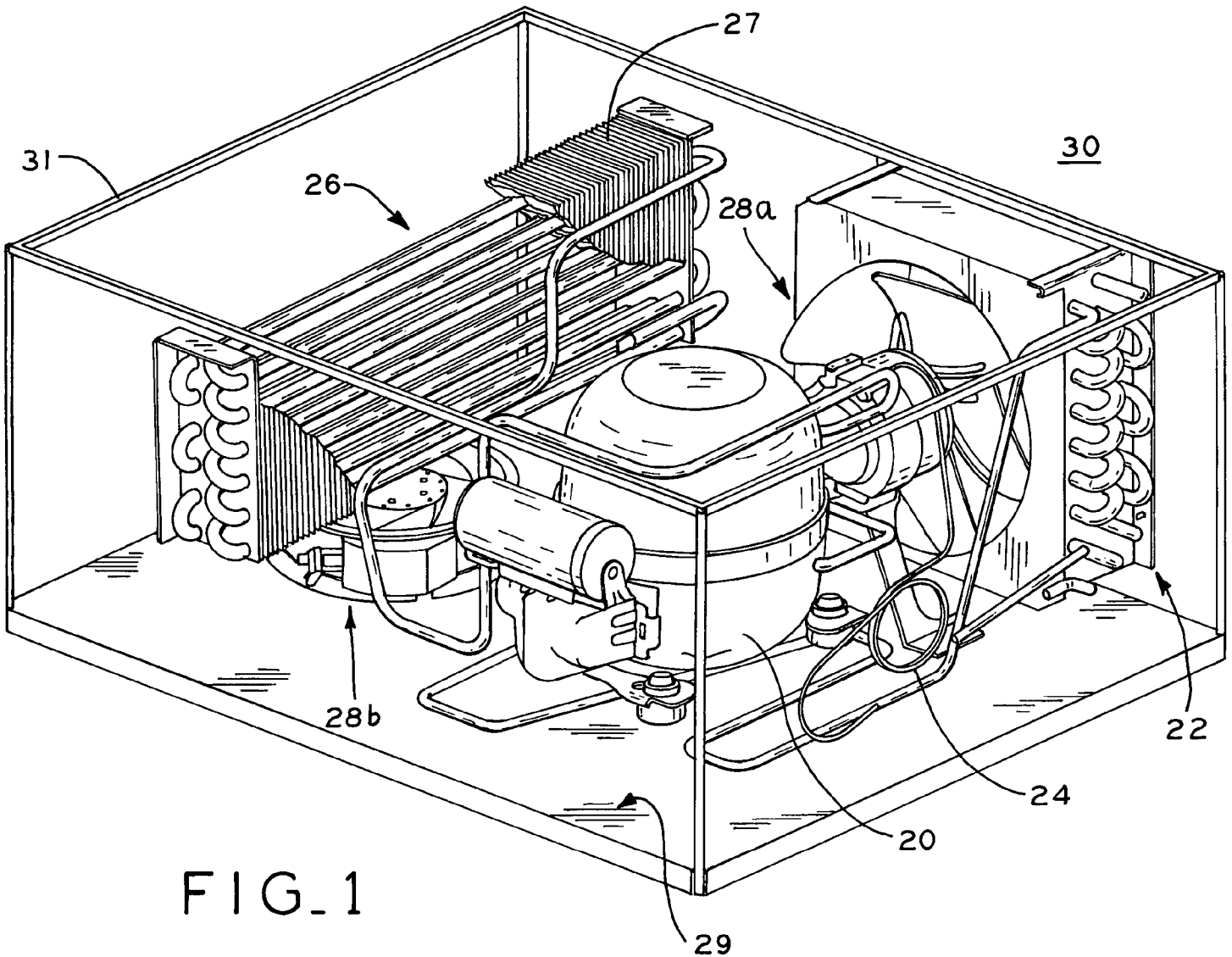
FIG. 1 is a perspective view of a known CRS.
Figure 3:
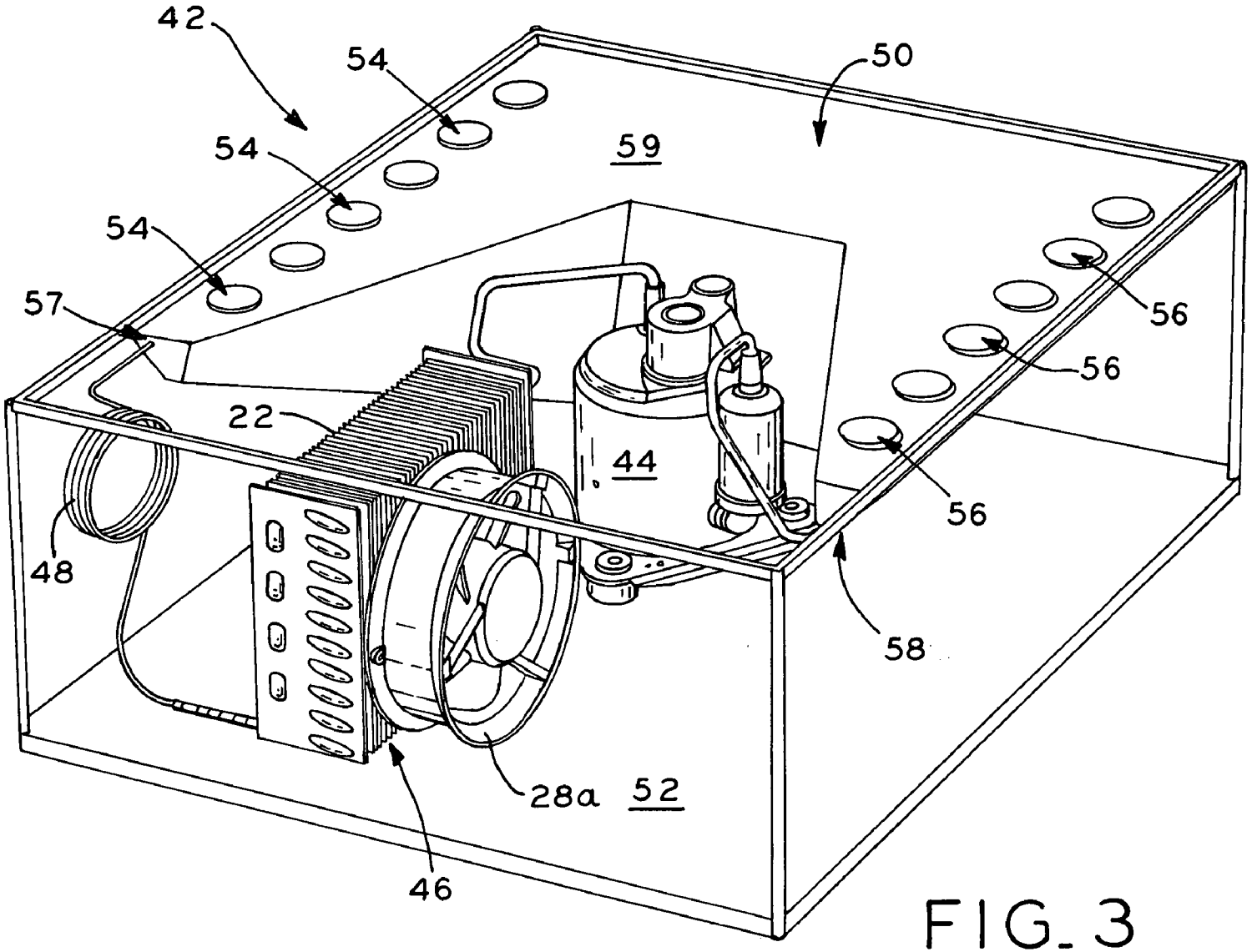
FIG. 3 is a perspective view of the CRS of FIG. 2.
Figure 4:
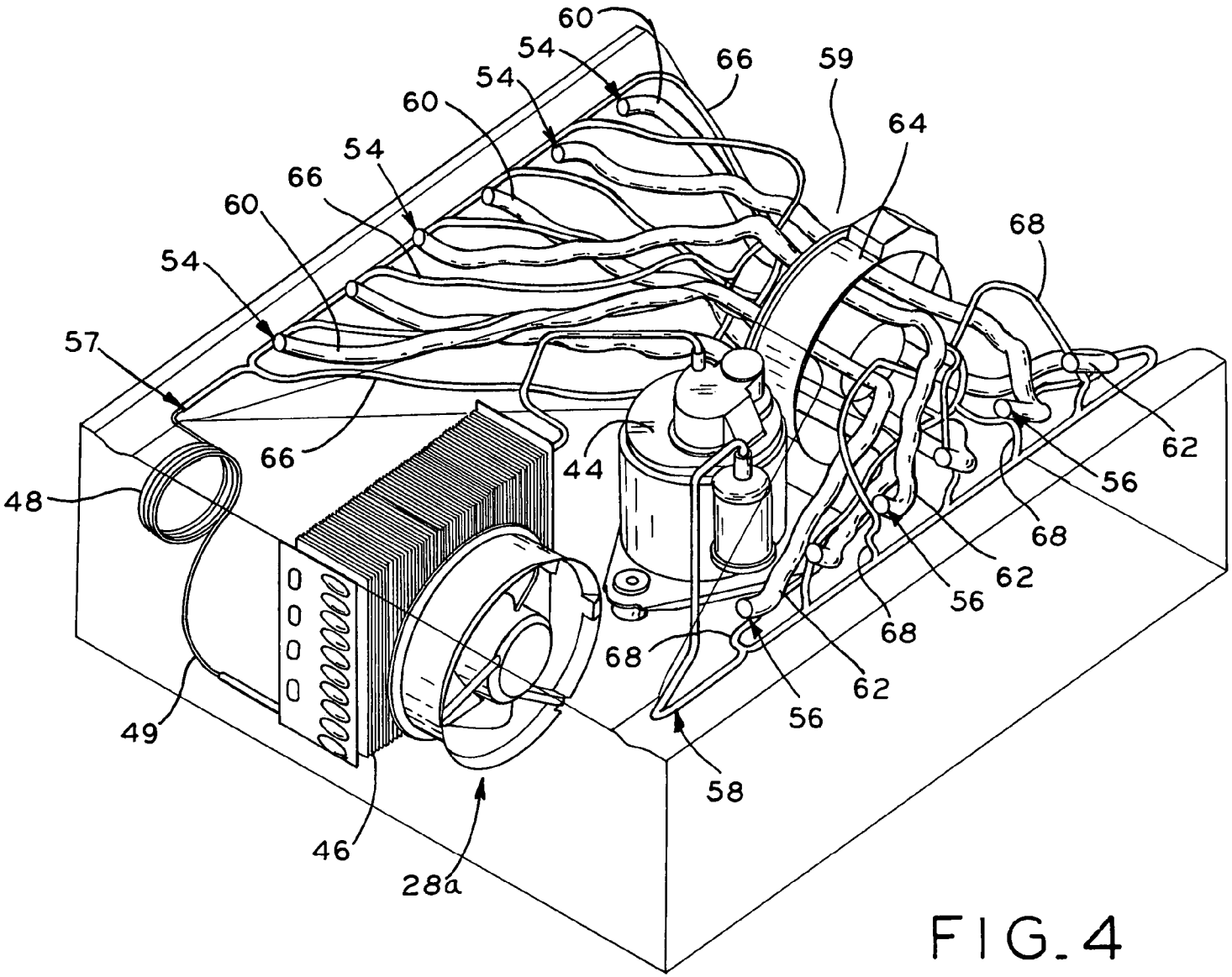
FIG. 4 is another perspective view of the CRS, with the solid body of the evaporator shown only in connection with the fluid and refrigerant passageways therewithin.
Figure 5:
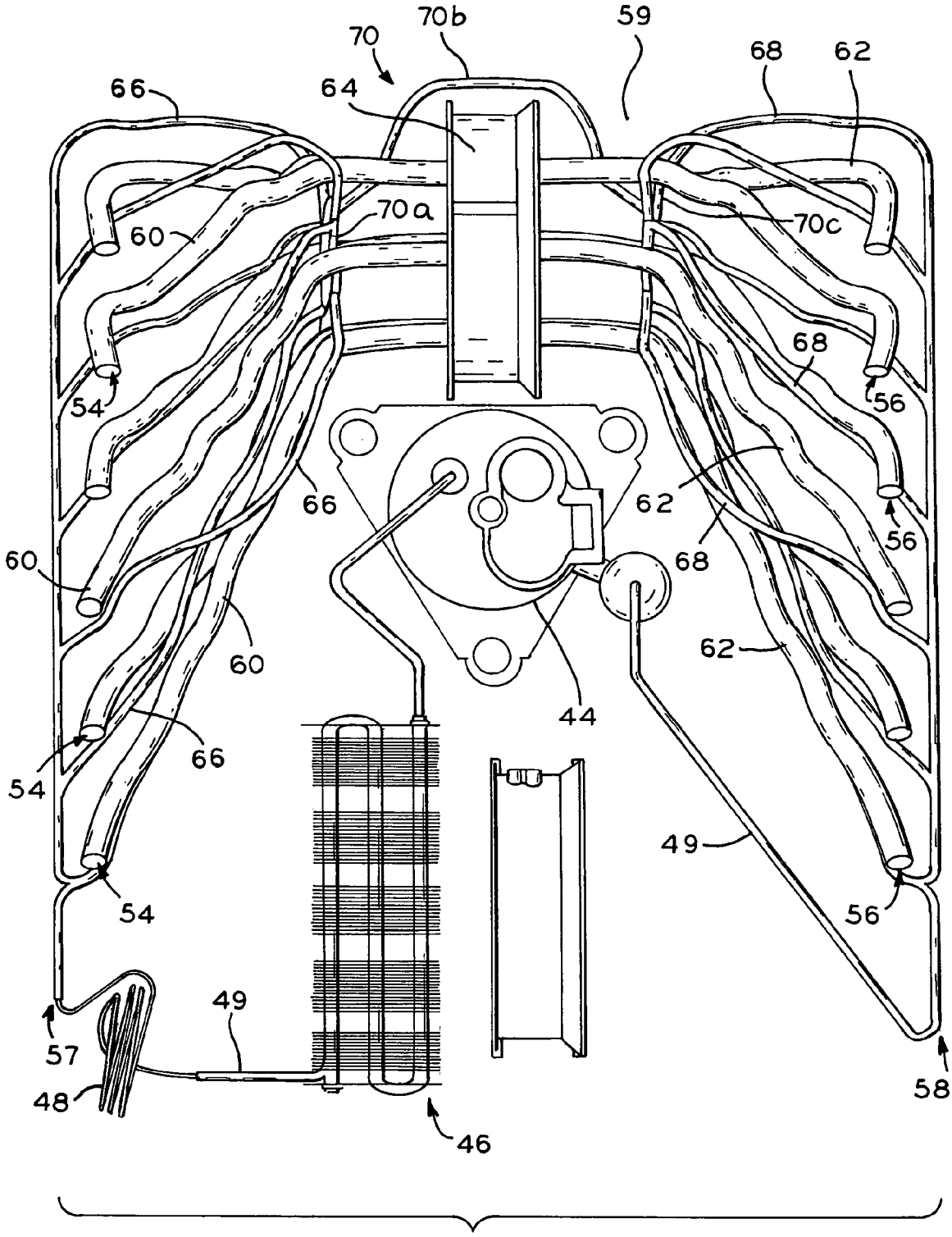
FIG. 5 is a top plan view of the CRS.

In FIGS. 3-5, CRS 42 is shown independently of vending machine 38, and includes an exemplary heat exchanger of the present invention, shown as evaporator 50. Evaporator 50 includes a substantially solid body 59 that in shape or profile, may advantageously extend partially around compressor 44 in the manner described below to more effectively utilize the space within the overall rectangular profile of CRS 42 and, in turn, to more effectively utilize the available lower interior volume 38 of vending machine 32 of FIG. 1. Evaporator 50 includes a plurality of fluid inlets 54 and a plurality of fluid outlets 56 in solid body 59, and also includes at least one refrigerant inlet 57 and at least one refrigerant outlet 58 in solid body 59.

Figure 6:
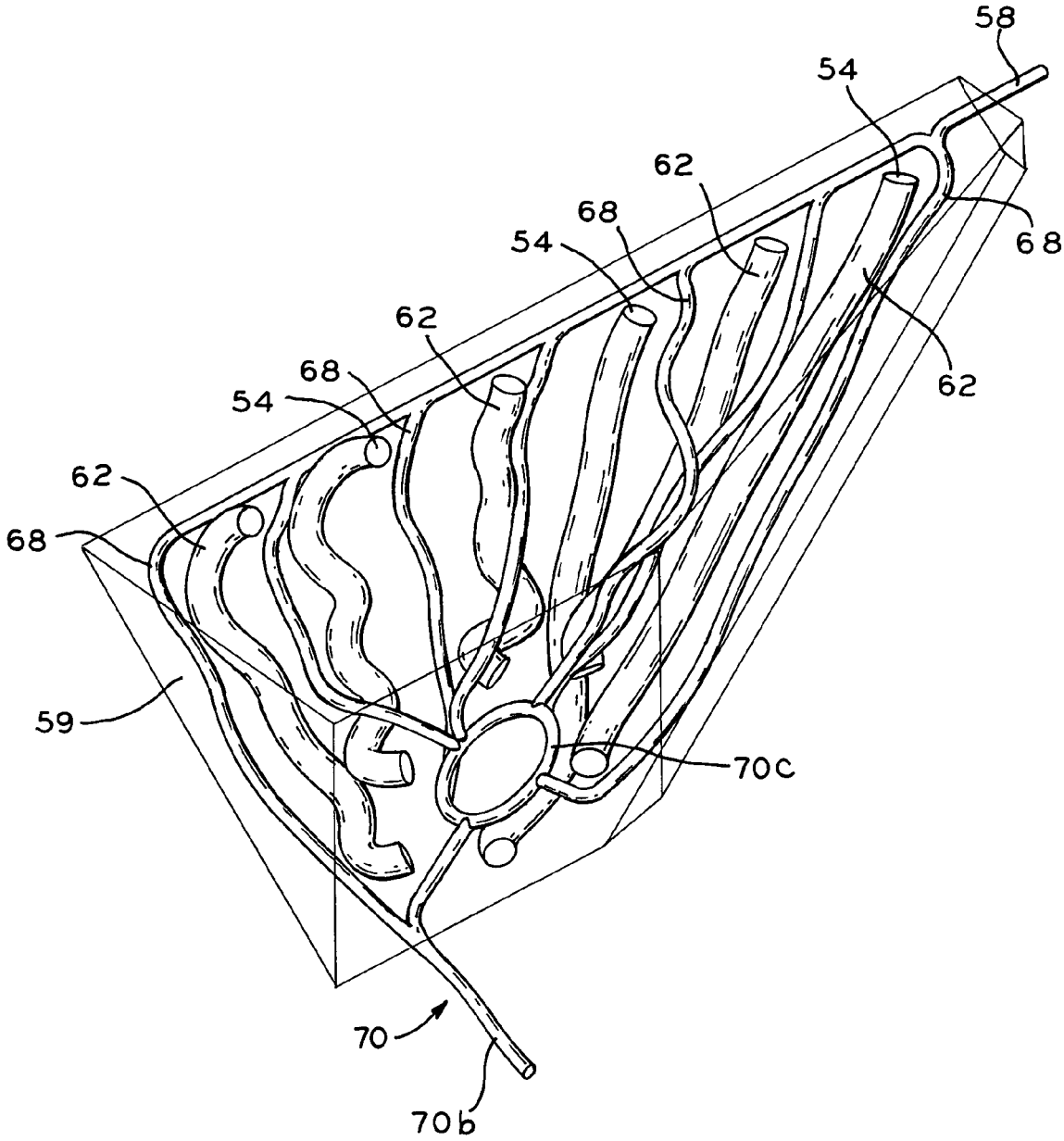
FIG. 6 is a perspective view showing one half of the evaporator of the CRS, with the solid body of the evaporator body shown in phantom to illustrate the fluid and refrigerant passages therewithin.

FIGS. 4 and 5 show CRS 42 with the solid body 59 of evaporator 50 shown absent or transparent in order to illustrate the fluid and refrigerant passageways defined within solid body 59 of evaporator 50, as described below. FIG. 6 shows one-half of evaporator 50, with solid body 59 thereof shown in phantom in order to illustrate the fluid and refrigerant passageways defined therewithin. Referring to FIGS. 4-6, the solid body 59 of evaporator 50 defines a plurality of fluid passageways therewithin, including a first plurality of fluid passageways 60 and a second plurality of fluid passageways 62. Fluid passageways 60 and 62 each have substantially round or circular cross-sections; however, other cross-sectional shapes may be used as desired.

Fluid passageways 60 each begin at a respective fluid inlet 54 and terminate substantially near a fluid moving device 64 which is positioned within a cavity 79 (FIG. 8) disposed within solid body 59 of evaporator 50. In one exemplary embodiment, fluid moving device 64 is an air fan, but also could be a type of pump. Fluid moving device 64 is in fluid communication with both pluralities of fluid passageways 60 and 62 and, in operation, moves air from upper interior volume 36 of vending machine 32 through fluid passageways 60 and 62, and then discharges the air back into upper interior volume 36. Fluid passageways 62 each begin at fluid moving device 64, opposite fluid passageways 60, and terminate at respective fluid outlets 56.

As described below, for any given irregular shape or profile of evaporator 50, fluid passageways 60 and 62 may be configured for an optimal spatial orientation to facilitate efficient transfer of thermal energy between refrigerant passageways 66 and 68, wherein at least some of the fluid passageways 60 and 62 have differing relative extents of travel through solid body 59 of evaporator 50 between their respective fluid inlets 54 and their respective fluid outlets 56 and are oriented non-parallel to each other.

Evaporator 50 also includes a first plurality of refrigerant passageways 66 and a second plurality of refrigerant passageways 68, shown in FIG. 4, which are in fluid communication with refrigerant conduits 49 of CRS 42. In one exemplary embodiment, the refrigerant can be carbon dioxide, a hydrofluorocarbon, or any other substance used to provide cooling or heating either as a working substance or by direct absorption or dissipation of heat. Refrigerant passageways 66 and 68 have substantially round cross-sections; however, other cross-sectional shapes may be used as desired. While only a single refrigerant inlet 57 and a single refrigerant outlet 58 are depicted in solid body 59 of evaporator 50, in other embodiments, solid body 59 of evaporator 50 may include a plurality of refrigerant inlets and refrigerant outlets associated with respective refrigerant passageways 66 and 68. Refrigerant inlet 57 is in fluid communication with expansion device 48 located downstream of condenser 46 in the refrigerant circuit of CRS 42, and refrigerant outlet 58 is in fluid communication with the inlet of compressor 44.

The first plurality of refrigerant passageways 66 are in fluid communication with refrigerant inlet 57 and converge substantially at fluid moving device 64, merging into a single refrigerant passageway 70, shown in FIG. 5, which includes a circular portion 70*a* disposed proximate fluid moving device 64. Refrigerant passageway 70 also includes a bypass portion 70*b* bypassing fluid moving device 64 and connecting circular portions 70*a* and 70*c* of refrigerant passageways 66 and 68. Circular portion 70*c* of refrigerant passageway 68 is also disposed proximate fluid moving device 64, and diverges into a plurality of individual refrigerant passageways 68 which extend through solid body 59 of evaporator 50 and are in fluid communication with refrigerant outlet 58.

As described below, and similar to fluid passageways 60 and 62, for any given irregular shape or profile of evaporator 50, refrigerant passageways 66 and 68 may be configured for an optimal spatial orientation to facilitate the efficient transfer of thermal energy between fluid passageways 60 and 62, wherein at least some of the refrigerant passageways 66 and 68 have differing relative extents of travel through solid body 59 of evaporator 50 between refrigerant inlet 57 and refrigerant outlet 58 and are oriented non-parallel to each other.

In use, refrigerant is circulated through the refrigerant circuit of CRS 42 as follows. Compressor 44 compresses refrigerant from a relatively low suction pressure to a relatively high discharge pressure, and the high pressure refrigerant passes through condenser 46. Fan 28*a* blows air over condenser 46 from the ambient environment to extract heat from the refrigerant and discharge the heated air externally of vending machine 32. The refrigerant then passes through expansion device 48 and into refrigerant inlet 57 of evaporator 50. Thereafter, the low pressure refrigerant passes through first refrigerant passageways 66, refrigerant passageway 70 and refrigerant passageways 68 before exiting evaporator 50 at refrigerant outlet 58 and returning to the suction inlet of compressor 44.

Concurrently, fluid moving device 64 moves air from upper interior volume 36 of vending machine 32 through inlets 54 of evaporator 50. Thence, the air is moved through first plurality of fluid passageways 60, through fluid moving device 64, and thence through second plurality of fluid passageways 62 before being discharged through fluid outlets 56 back into upper interior volume 36 of vending machine 32. Within evaporator 50, the close physical proximity of refrigerant passages 66 and 68 to fluid passages 60 and 62, respectively, within solid body 59 of heat exchanger 50 facilitates the transfer of heat by conduction from the air in fluid passages 60 and 62 to the refrigerant within refrigerant passages 66 and 68, respectively. In this manner, heat is extracted from the air and transferred to the refrigerant to provide cooling to upper interior volume 36 of vending machine 32. As described below, evaporator 50 and/or condenser 76 (FIG. 7)*may* be constructed such that the spatial orientations of the air and refrigerant passageways therein is optimized for any given irregular shape or profile defined by evaporator 50 and/or condenser 76 to provide efficient transfer of heat between the air and the refrigerant.

Although fluid passages 60 and 62 have been described with reference to air as the fluid, fluid passageways 60 and 62 can be used to cool or heat any number of fluids, such as water or any other fluid for which the addition or removal of thermal energy is desirable. Additionally, although solid body 59 has been described with fluid passageways 60 and 62 and refrigerant passageways 66 and 68, solid body 59 can lack refrigerant passageways 66 and 68 and can itself be heated or cooled to provide the desired transfer of thermal energy to the fluid of fluid passageways 60 and 62. In exemplary embodiment, solid body 59 has only fluid passageway 60 and 62 and solid body 50 acts as the heat transfer medium. Solid body 59 can be heated or cooled to provide the desired transfer of thermal energy by contact with an externally heated or cooled surface, by microwave radiation, or by any other means capable of transferring thermal energy to or away from solid body 59.

Figure 7:
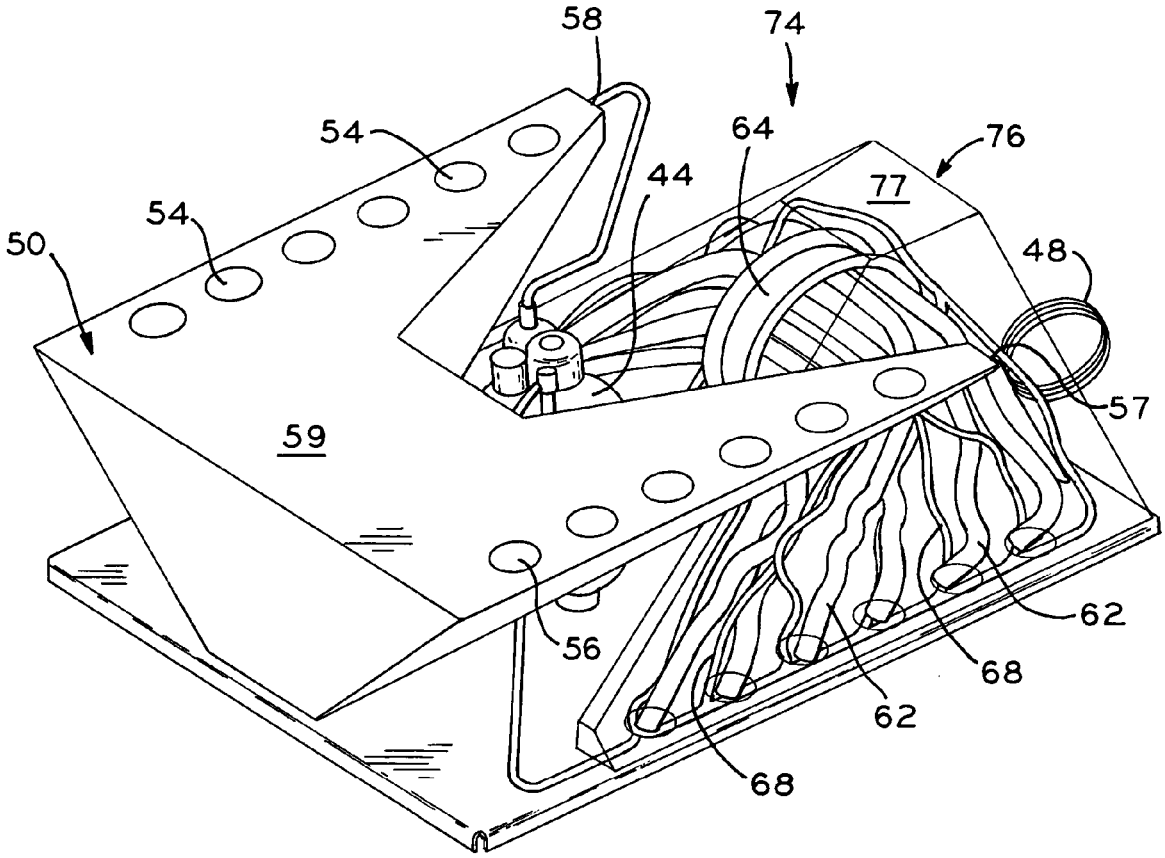
FIG. 7 is a perspective view of a CRS having both an evaporator and a condenser in accordance with the present invention, with the condenser body shown only in connection with the fluid and refrigerant passageways therewithin.

FIG. 7 depicts another exemplary embodiment of a CRS in accordance with the present invention. Except as described below, CRS 74 of FIG. 7 is substantially identical to CRS 42 of FIG. 3-5 discussed above, and identical reference numerals will be used to designate identical or substantially identical features therebetween. CRS 74 includes evaporator 50 as discussed above, and also includes a second heat exchanger, in the form of condenser 76, which is substantially identical in construction and operation to evaporator 50. In particular, condenser 76 includes a substantially solid body 77 having fluid 62 and refrigerant 68 passages therewithin, as well as a fluid moving device 64. Solid body 77 of condenser 76 is shaped to advantageously extend partially around compressor 44 and to a profile which is complementary to that of evaporator 50 as shown in FIG. 7 to more effectively utilize the space within the overall rectangular profile of CRS 42 and, in turn, to more effectively utilize the available lower interior volume 38 of vending machine 32 of FIG. 1. The refrigerant passageways 68 of condenser 76 are in fluid communication with the discharge of compressor 20 and the fluid passageways 62 of condenser 76 are in fluid communication with the ambient environment. In use, condenser 76 operates to extract heat from the refrigerant in refrigerant passages 68 to the air which is moved from the ambient environment through fluid passageways 62 therein before the heated air is discharged back into the ambient environment.

Figure 8:
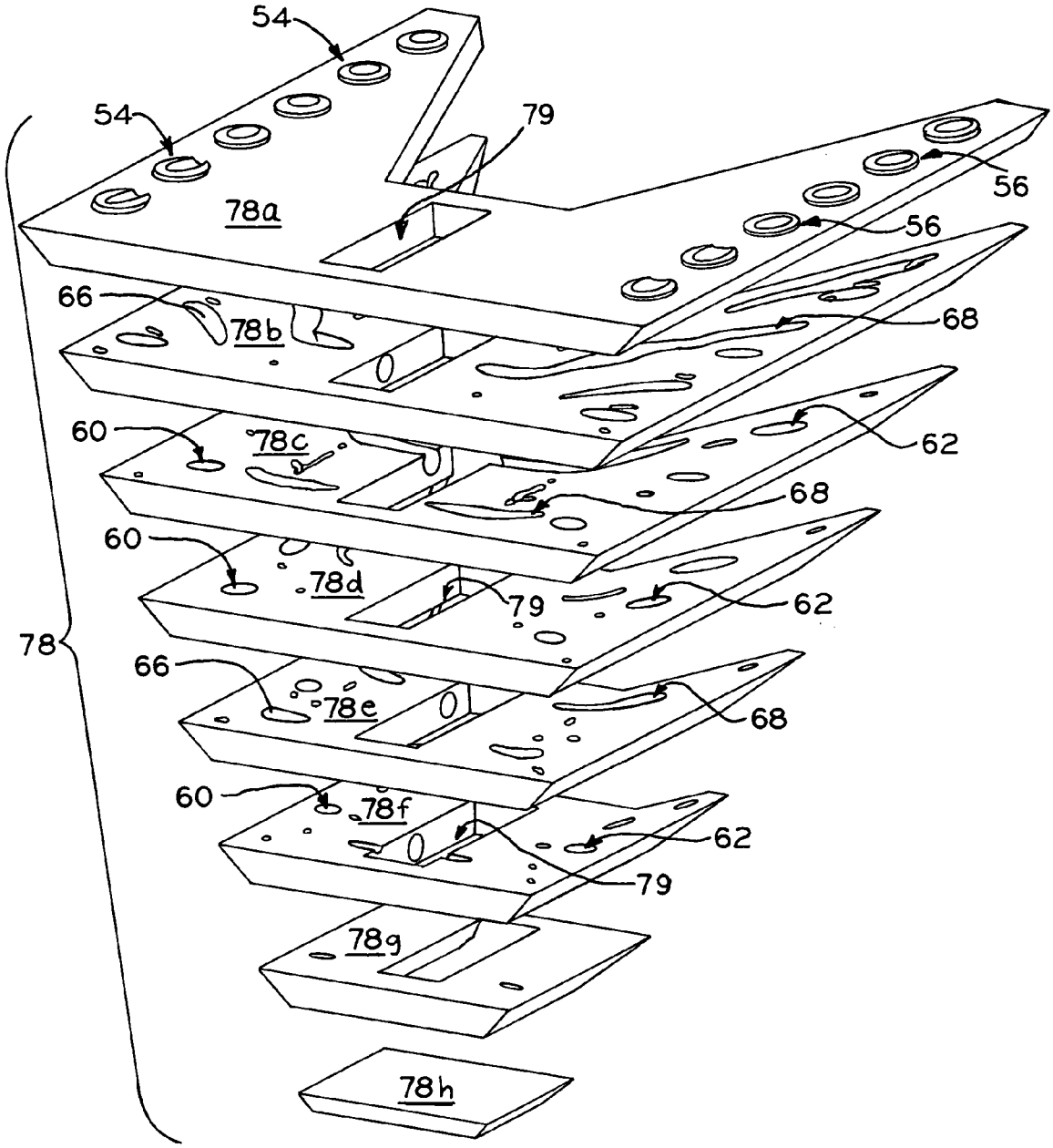
FIG. 8 is an exploded perspective view of the evaporator of the present invention, showing individual slices that, taken together, form the evaporator.

FIG. 8 depicts one exemplary method of constructing a heat exchanger which has an irregular shape or profile, such as evaporator 50. Once the shape of evaporator 50 and the spatial orientation of the refrigerant and fluid passageways thereof are determined, such as via the method described below, evaporator 50 may be divided into a number of individual layers or slices 78. Slices 78 may be manufactured individually by stamping same from a thermally conductive metal such as aluminum, for example, by using a progressive die assembly or via investment casting techniques. Alternatively, the individual slices may be manufactured by solidification transformation or layer addition, such as via the ultrasonic object consolidation method disclosed in U.S. Pat. No. 6,519,500 to White et al., the disclosure of which is incorporated herein by reference, or via any other suitable method. If the slices are made of plastic, suitable thermally conductive plastics include polyether ether ketone (PEEK), KJ Kapton®, EKJ Kapton®, and Teflon®, manufactured by E. I. duPont de Nemours & Co. of Wilmington, Del. (KJ Kapton®, EKJ Kapton®, and Teflon® are registered trademarks of E. I. duPont de Nemours & Co.). Additionally, the slices can be made out of non-plastic, non-metallic materials, including SiC, $MoSi_2$, $Ti_2SiC_2$, $Si_3N_4$, $Al_2O_3$, SiAlON, and $Mg_2Al_4Si_5O_{18}$ (Cordierite).

Referring to FIG. 8, each slice 78*a*-78*h* is affixed a corresponding slice 78*a*-78*h* to form substantially solid body 59 via suitable interlock members or fasteners and seals (not shown) or via integral bonding between the slices, depending upon the method and manner of their manufacture. Slices 78*a*-78*g* together define cavity 79 for fluid moving device 64. Slice 78*a* contains fluid inlets 54 and fluid outlets 56, and the various slices have openings therethrough that define portions of both fluid passageways 60 and 62 and refrigerant passageways 66 and 68 such that the individual slices, when taken together, define solid body 59 of the heat exchanger as well as the refrigerant and fluid passages therewithin.

Figure 9:
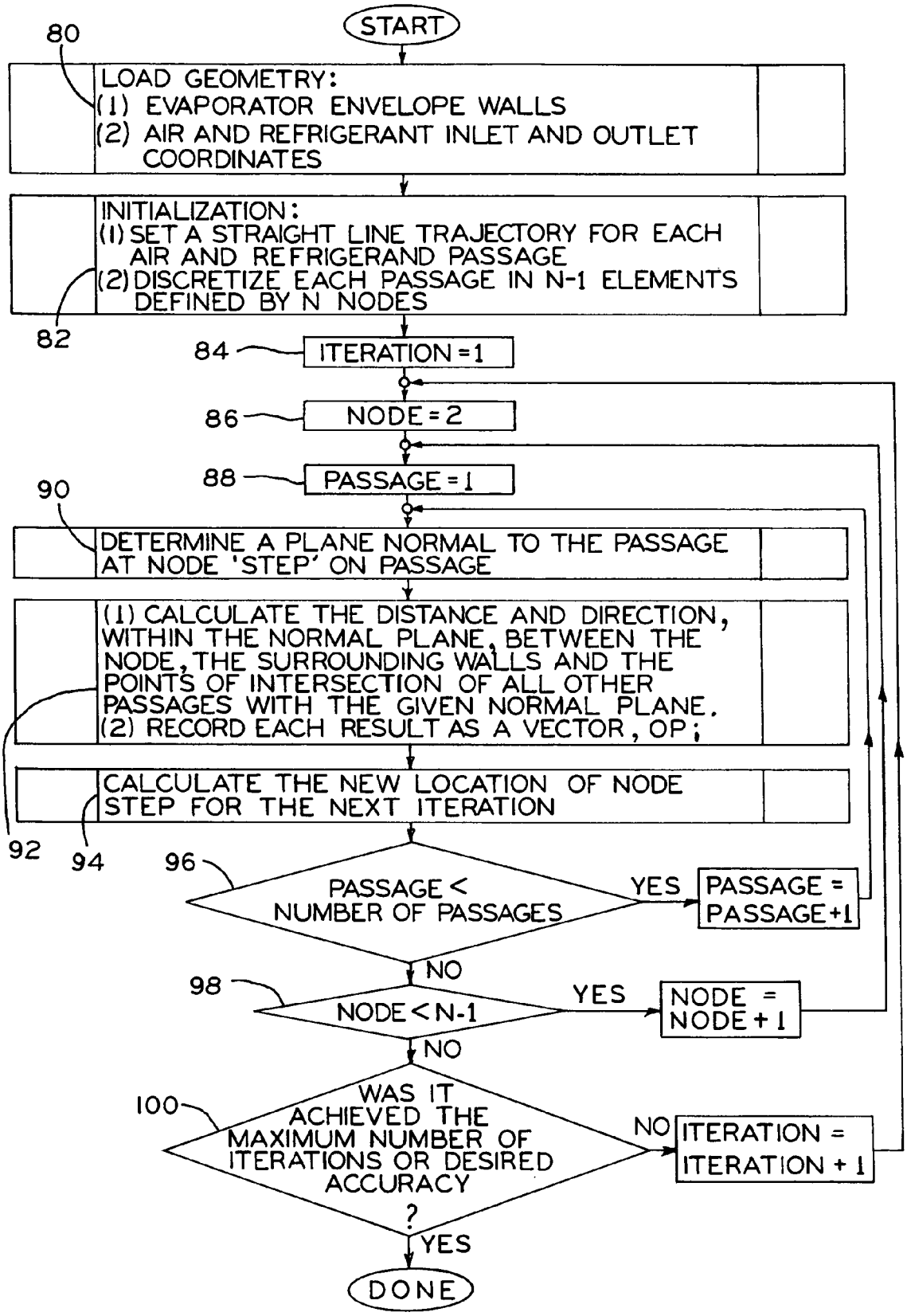
FIG. 9 is a flow chart illustrating exemplary method steps for determining an optimal spatial arrangement or orientation of the fluid and refrigerant passageways with respect to one another and with respect to the walls of a heat exchanger.
Figure 10:
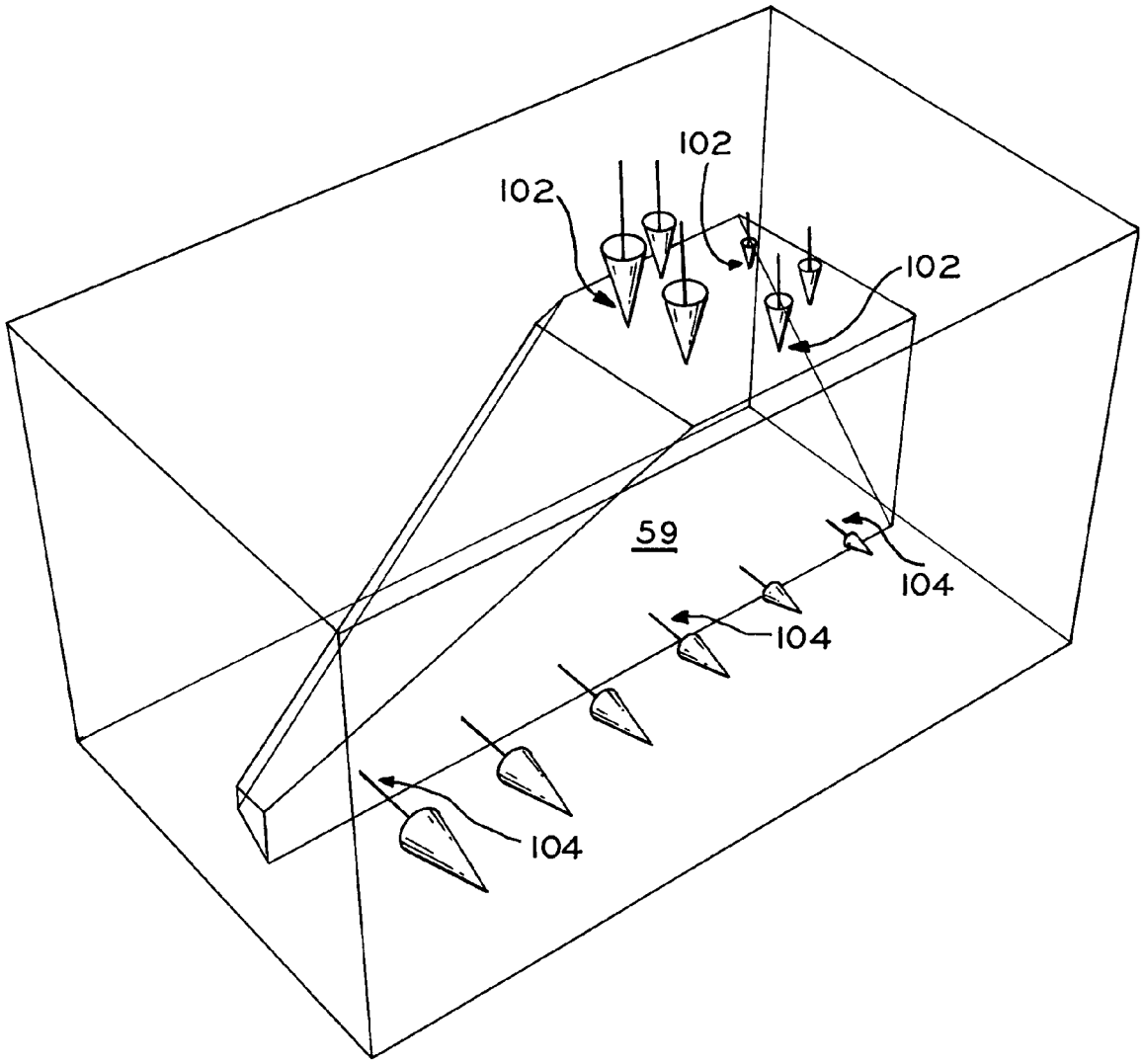
FIG. 10 is a perspective view of one-half of the solid body of the evaporator illustrating a step of the exemplary method of FIG. 9.

As described below, the spatial orientation of the refrigerant and fluid passageways within the heat exchangers may be optimized to provide efficient heat transfer between the refrigerant and fluid passageways within any given irregular shape or profile of the heat exchanger. FIG. 9 illustrates steps of an exemplary method for determining the optimal coordinates for spatially orienting each of fluid passageways 60 and 62 and refrigerant passageways 66 and 68 with respect to each other and to the outer surfaces of solid body 59 of evaporator 50. In step 80, as depicted by FIG. 10, the geometry of the heat exchanger and the desired coordinates of the air and refrigerant inlets and outlets of the heat exchanger are entered. FIG. 10 shows inlets 102 depicted by arrows, and corresponding outlets 104 depicted by correspondingly sized arrows. Generally, the number of inlets and outlets, and their locations with respect to the geometry of the heat exchanger, may vary depending upon the geometry of the particular application. Preferably, the foregoing information is entered into a computer which executes a design or manufacturing program such as CAD/CAM.

Figure 11:
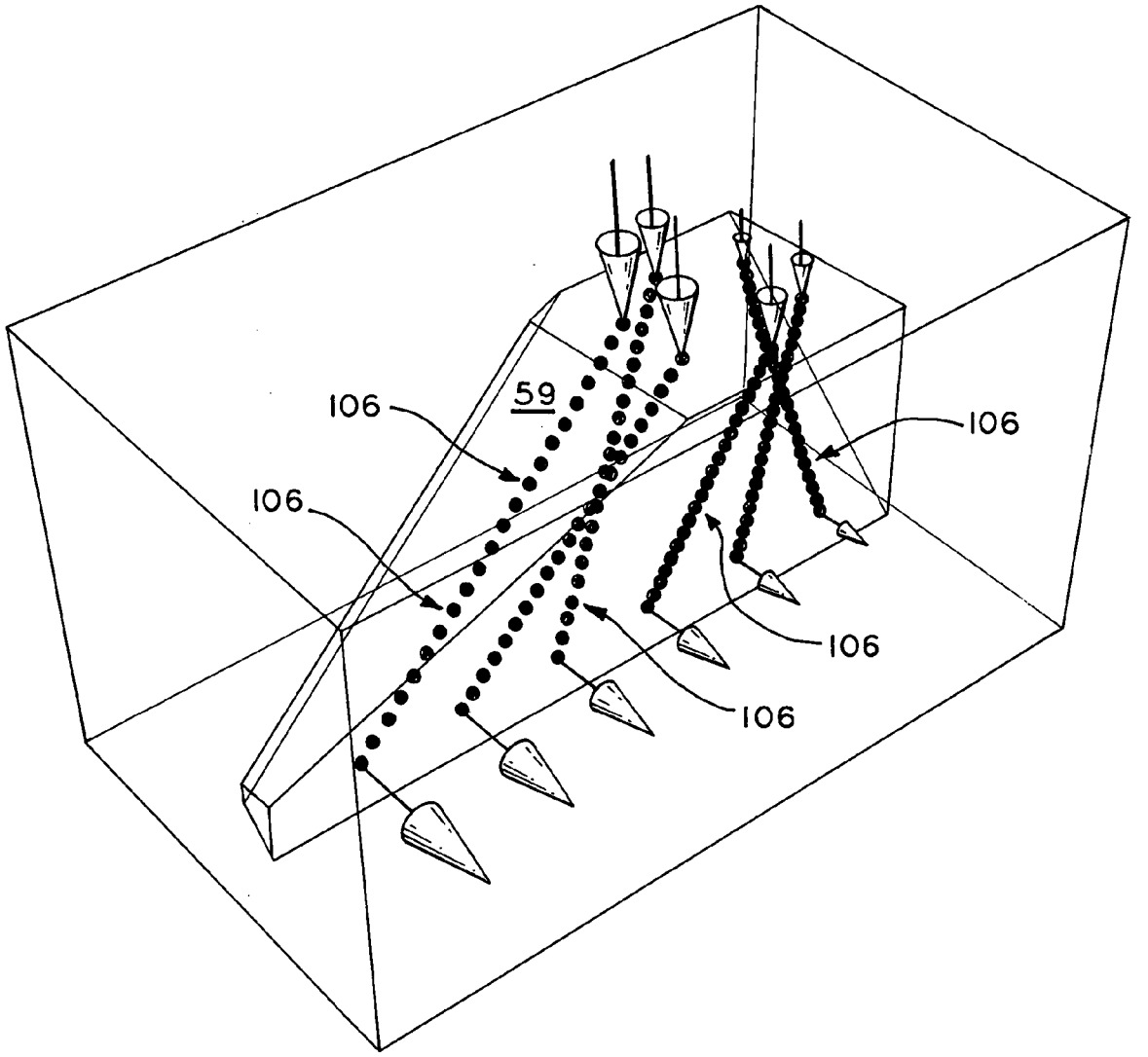
FIG. 11 is a further perspective view of one-half of the solid body of the evaporator illustrating an additional step of the exemplary method of FIG. 9.

Step 82(1), depicted in FIG. 11, sets a straight line between the air and refrigerant inlets and their respective outlets, which lines will ultimately define passages through the solid body of the heat exchanger. Step 82(2) calls for the passages to be discretized into N−1 elements, where N is a whole number greater than 1. N represents a number of nodes 106 placed along each passageway, with respective nodes positioned at both the inlet and outlet of each passageway and the remaining nodes 106 equally spaced therebetween. Having an N, or number of nodes per passageway, of approximately 10 will generally provide an acceptable result. However, as described below, the greater the number of nodes 106 used, the greater the number of elements the computer will analyze, resulting in a more refined result. Alternatively, the lower the number of nodes 106 used, the fewer the number of elements the computer will analyze, resulting in a less refined result.

Figure 12:
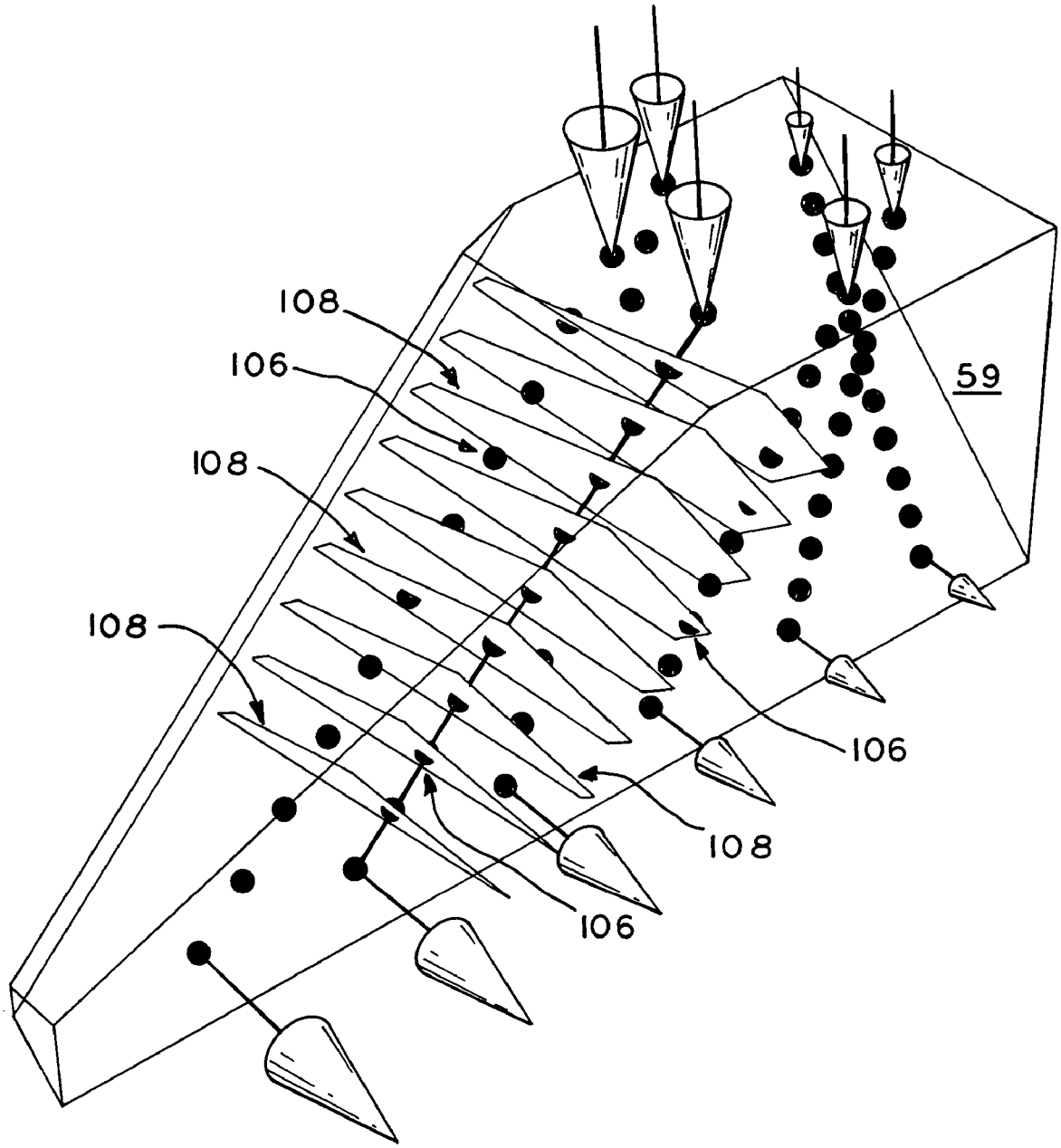
FIG. 12 is a still further perspective view of one-half of the solid body of the evaporator illustrating an additional step of the exemplary method of FIG. 9.

Step 84 indicates that the iteration is set to 1. Step 86 sets N equal to 2. This prevents any calculation of the optimal placement of node 1, i.e., the inlet, since this coordinate is fixed. Step 88 sets the passageway to one, so that the following steps are performed in relation to the first passageway. Referring to FIG. 12, step 90 determines a plane 108 passing through the second node on the first passageway and having an orientation perpendicular to the passageway. Step 92(1) calculates the vector for the second node of the first passageway and the intersection point of the plane 108 with the outer surfaces of solid body 59 and all other passages intersected by plane 108 of step 90. After each vector calculation of Step 92(1) the result is recorded in Step 92(2) as vectors $OP_i$. Step 94 performs a calculation for each vector $OP_i$ recorded in Step 92(2) resulting from the calculation at Step 92(1). The calculation at Step 94 determines the most efficient location for the second node of the first passage.

The calculation at step 94 to determine the most efficient location of the second node of the first passageway is expressed, in part, by the following equation, wherein a $Disp_{o,i}$ for the node at O is calculated with respect to the intersection point of an individual passageway or wall "i", defined as $P_i$:

$$Disp_{o,i} = \frac{RC_a}{\text{Maximum}(\text{Min}_a, |OP_i|)^{RE_a}} \frac{OP_i}{|OP_i|}$$

wherein:

O=geometric location of Node of a passageway on the normal plane $P_i$=intersection point of passageway or wall "i" on the normal plane $Disp_{o,i}$=vector compensating for closeness of Node to passageway or wall "i"

$RC_a$=value coefficient quantifying sensitivity of Node to closeness of another passageway $RE_a$=value coefficient quantifying non-linear sensitivity of Node to closeness of another passageway $Min_a$=minimum distance allowed between two adjacent passages $OP_i$=vector between O and $P_i$, calculated at Step 92(1)

Once the $Disp_{o,i}$ is calculated, the result is recorded and the equation is repeated, changing $P_i$ and vector $OP_i$ to correspond to the intersection point of a different passageway or wall of solid body 59 on the normal plane 108. Additionally, variables $RC_a$, $RE_a$, $Min_a$ will vary depending on the function of the passageways, i.e. whether it is a fluid passageway or a refrigerant passageway, on which the current node, O, and intersection point, $P_i$, are located. By summing all vectors $Disp_{o,i}$, Step 94 determines the most efficient location for the node.

Decision 96 instructs the computer to determine if the passageway on which steps 90-94 operated is less than the total number of passages. If decision 96 is true, one is added to the passageway number on which steps 90-94 previously operated and steps 90-94 are repeated. If decision 96 is false, decision 98 instructs the computer to determine if the node 106 previously operated on by steps 88-94 is less than N−1. If decision 98 is true, one is added to the node and steps 88-94 and decision 96 are repeated. If decision 98 is false, decision 100 instructs the computer to determine if either the maximum number of iterations has been performed or a desired accuracy has been reached. Generally, performing 10 iterations will create an acceptable result. However, the number of iterations performed is directly proportional to the refinement of the results. Thus, the more iterations the computer performs, the more refined the results and, alternatively, the less iterations the computer performs, the less refined the results. If either the maximum number of iterations has been performed or the desired accuracy has been reached, the program terminates. Otherwise, one is added to the number of iterations and steps 86-94 and decisions 96-100 are repeated.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heat exchanger, comprising:

a substantially solid body having a volume;

a plurality of first individually self-contained air-conducting passageways within said solid body extending between a plurality of respective air inlets and a plurality of respective air outlets, at least two of said first passageways having different relative extents of travel between their respective inlets and outlets;

a plurality of second individually self-contained refrigerant-conducting passageways within said body extending between a plurality of respective refrigerant inlets and a plurality of respective refrigerant outlets;

an air moving device having a plurality of inlets and outlets connected respectively to said air-conducting passageways to thereby move air through said air-moving device from the respective passageway inlets to the respective passageway outlets;

a plurality of said first air-conducting passageways being oriented non-parallel to each other and a plurality of said second refrigerant passageways being oriented non-parallel to each other; and wherein said solid body comprises more than two layers of thermally conductive material each having geometrically planar faces extending from one edge to an opposite edge of the layer, said layers being stacked one against another with adjacent planar faces in abutment to thereby form said solid body, individual ones of said layers having openings extending transversely therethrough from one planar face thereof to the opposite planar face thereof, the openings in the layers being aligned with openings in adjacent layers to form said first passageways.

2. The heat exchanger of claim 1, wherein the fluid moving device is a fan, said fan operable to move air through said plurality of first passageways from said air inlets to said air outlets.

3. The heat exchanger of claim 1, wherein said plurality of first, air-conducting passageways and said plurality of second, refrigerant-conducting passageways are disposed substantially entirely within said body.

4. The heat exchanger of claim 1, wherein said solid body consists essentially of a thermally conductive plastic.

5. The heat exchanger of claim 1, wherein individual ones of said layers have second openings extending transversely therethrough from one planar face thereof to the opposite planar face thereof, the openings in the layers being aligned with second openings in adjacent layers to form said second refrigerant-conducting passageways.

6. A complete refrigeration system, comprising:

a refrigerant circuit including, in serial order, a compressor, a first heat exchanger, an expansion device, and a second heat exchanger, one of said first and second heat exchangers comprising:

a substantially solid body having a volume;

a plurality of first individually self-contained air-conducting passageways within said body and extending between a plurality of respective air inlets and a plurality of respective air outlets, at least two of said first air-conducting passageways defining different relative lengths between their respective inlets and outlets; and an air moving device having a plurality of inlets and outlets connected respectively to said air-conducting device to thereby move air through said air-moving passageways from the respective passageway inlets to the respective passageway outlets;

a plurality of second individually self-contained refrigerant-conducting passageways within said body and extending between a plurality of respective refrigerant inlets and a plurality of respective refrigerant outlets;

a plurality of said first passageways being oriented non-parallel to each other and a plurality of said second refrigerant passageways being oriented non-parallel to each other; and wherein said solid body comprises more than two layers of thermally conductive material each having geometrically planar faces extending from one edge to an opposite edge of the layer, said layers being stacked one against another with adjacent planar faces in abutment to thereby form said solid body, individual ones of said layers having openings therethrough from one planar face thereof to the opposite planar face thereof, the openings in the layers aligned with openings in adjacent layers to form said first passageways.

7. The complete refrigeration system of claim 6, wherein said air inlets and outlets are in fluid communication with an enclosed space.

8. The complete refrigeration system of claim 6, wherein at least one of said first and second heat exchangers is one of a condenser and evaporator.

9. The complete refrigeration system of claim 6, wherein said substantially solid body extends at least partially around said compressor.

10. The system of claim 6, wherein said solid body consists essentially of a thermally conductive plastic.

* * * * *